United States Patent [19]

Iten

[11] 3,998,263

[45] Dec. 21, 1976

[54] SYSTEM TO MAKE METAL CASTING MOLDS

[75] Inventor: Fritz Iten, Balsthal, Switzerland

[73] Assignee: Von Roll AG, Gerlafingen, Switzerland

[22] Filed: Dec. 6, 1974

[21] Appl. No.: 530,159

[30] Foreign Application Priority Data

Dec. 13, 1973 Switzerland ..... 17484/73

[52] U.S. Cl. ..... 164/181; 164/207; 164/324; 164/24; 164/29

[51] Int. Cl.[2] ..... B22C 25/00

[58] Field of Search ..... 164/24, 27, 29, 169, 164/180, 181, 182, 183, 207, 210, 213, 214, 224, 227, 322, 323, 324, 329, 330; 425/246, 88

[56] References Cited

UNITED STATES PATENTS

| | | | |
|---|---|---|---|
| 2,570,717 | 10/1951 | Ronceray | 164/181 |
| 2,985,926 | 5/1961 | Fellows | 164/323 |
| 3,273,207 | 9/1966 | Taccone | 164/210 |
| 3,540,516 | 11/1970 | Taccone | 164/29 X |

FOREIGN PATENTS OR APPLICATIONS

| | | | |
|---|---|---|---|
| 506,838 | 12/1954 | Italy | 164/324 |

*Primary Examiner*—Francis S. Husar
*Assistant Examiner*—Gus T. Hampilos
*Attorney, Agent, or Firm*—Flynn & Frishauf

[57] ABSTRACT

To permit efficient utilization of expensive equipment in casting mold manufacturing systems, particularly of a molding press, pattern plates are cycled in one loop of a plurality of work stations, including the station in which molding sand is applied to the mold boxes or flasks, and the single press, and a second loop also including the single press and, preferably, also the sand application station is provided in which loose patterns are placed in flasks, so that the common work stations, and principally the molding press, is efficiently utilized.

8 Claims, 5 Drawing Figures

SYSTEM TO MAKE METAL CASTING MOLDS

The present invention relates to the preparation of casting molds, using casting sand, or the like, and including a molding press, and more particularly to such a system in which molds are made for repetitive casting with the same pattern and, additionally, to permit the preparation of molds of single patterns, while efficiently utilizing the equipment to make the molds.

Various types of systems including separate work stations, to make sand molds for metal castings, have been proposed; for efficient utilization of equipment, the systems are so arranged and laid out that the sand molds should provide uniform quality of the casting to be made, and to allow for uniformity in handling, wherever possible, so that the costs of the molds are reduced. The various work stations in casting or foundry layouts are then so arranged and related with respect to each other that the expensive components thereof are efficiently utilized at a high operating rate. Typical work stations in such a system include a station to place the mold box or flask, filling of sand, molding, i.e. compaction, or pressing of the sand, separation of the top half of the box, or cope portion and the bottom half of the box, or drag portion, and roll-over, or turning of the various portions; the most expensive components of the system, and especially the one most expensive component of the system which is the molding, or compaction press should have a high utilization rate.

Efficiently arranged systems, particularly for repetitive casting, usually require the use of pattern plates. These pattern plates, or carriers which, if needed, are assembled from pattern sub-carriers, then permit use of a molding box or flask or a single size, or at least of a single cross-sectional dimension, and with different height.

Using pattern carriers with standardized molding flasks simplifies the operations at the various stations which are required in order to make sand molding forms. Yet, such a system heretofore was subject to limitations. The most important limitation is this: Usually, the system is designed to be most efficient when used for mass production in large quantities. The utilization of the system for mass production then means that, to make smaller quantities, that is, to make only a few molds of any one pattern or, possibly, to make only a single mold of any one pattern, use of the system for such "job shop" operations was found to be inefficient, and thus the equipment and apparatus for use in a mass production system were not commercially easily adaptable to make only a few or only one mold from any one given pattern if the requirement for such smaller quantities arose. It was particularly difficult to efficiently utilize the expensive molding machine, used to compact the molding sand in the flask if only small quantities of any given pattern were to be made. Making only single molds of a single pattern in a system arranged for mass production heretofore was inefficient and economically undesirable. The efficient use of equipment was possible, therefore, only within the constraint of mass production; versatility of use of individual machines was undesirably affected.

It is an object of the present invention to provide a system and an arrangement to make casting molds which have the advantages of an integrated production loop to make, repetitively, large quantities of molds carried on pattern plates but which also permit use of the equipment forming part of the production system, or production loop, to make small numbers of molds from similar patterns, without use of a pattern plate, or only single molds, as desired, without detracting from the efficient utilization of the various components forming the equipment of the production system or production loop.

SUBJECT MATTER OF THE PRESENT INVENTION

Briefly, a single molding, or compaction, press is provided. To said press, mold boxes or flasks upon pattern plates, or pattern carriers are fed from a first production cycle, or loop. To that press are also fed mold boxes from a second production cycle or loop in which loose patterns are placed, for individual (or small series) production of mold forms. The flasks or mold boxes for loose (or small series) patterns are located on a plate which permits utilization of the expensive portions of the equipment, that is, the press (and, if desired, for example a sand filling station) conjointly for both production loops, provided that the common stations are suitably designed to accept the plate as well as flasks from the production loop in which mold plates are utilized.

The molding press thus is common to, and used both in a production path or production loop for high quantity, repetitive compaction of molds made from pattern carriers as well as molds made from loose patterns.

For a more detailed explanation of casting to which the present invention relates, reference is made to "Five moulds per minute" (Foundry Trade Journal 1968, Sept. 28, pg. 423–444) and "Hands or Heads?" (Foundry Trade Journal 1967, pg. 623 ff) and to the book "Fondamentals in the production and design of castings" by C.T. Marek, Ed. J. Wiley, New York.

The invention will be described by way of example with reference to the accompanying drawings, wherein.

Figure 1:
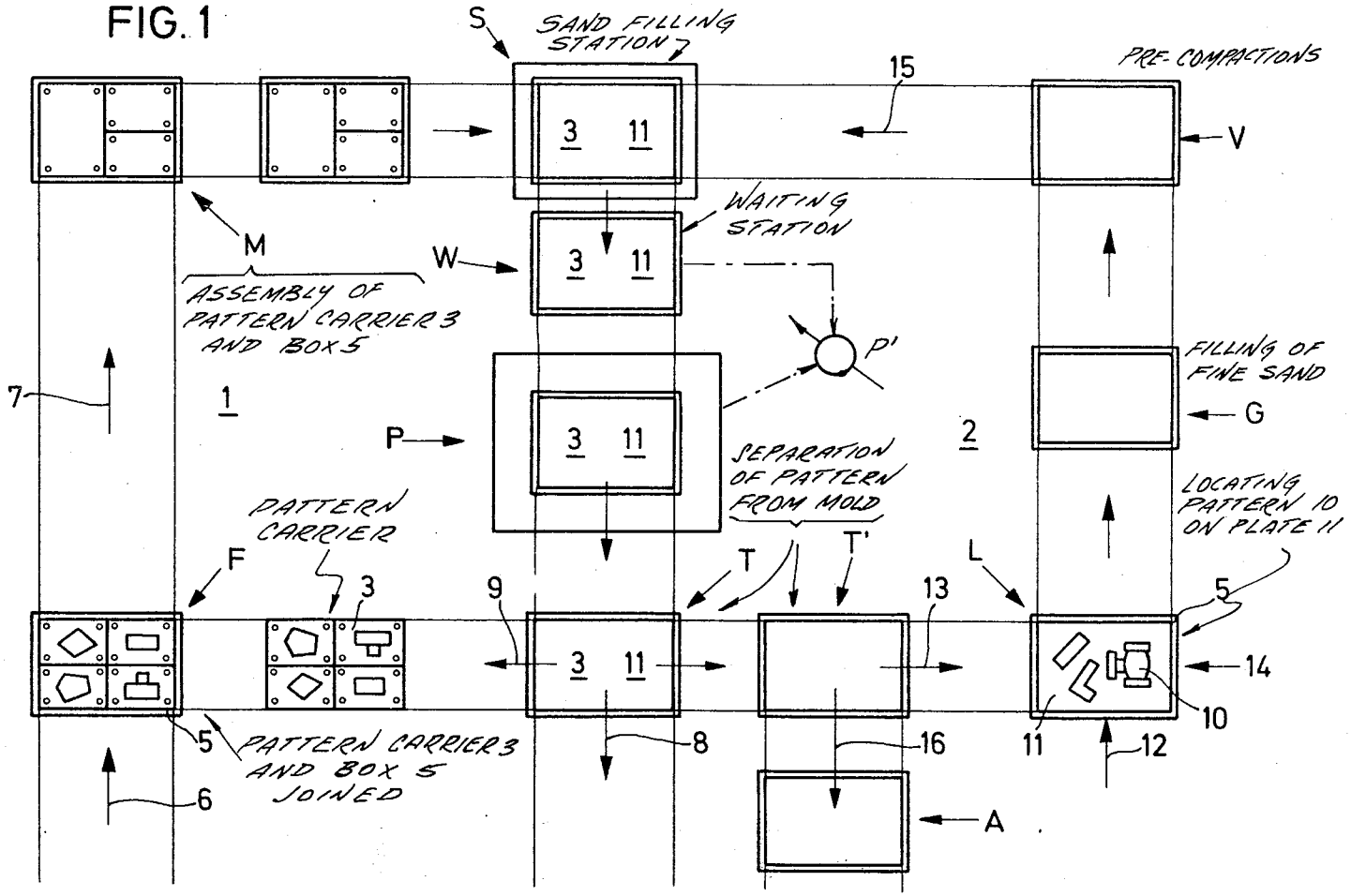
FIG. 1 is a highly schematic top view of a production system for the preparation of casting molds, both for large quantity, mass production molds using pattern plates and for molds without pattern plates, for example to make a single casting.
Figure 2:
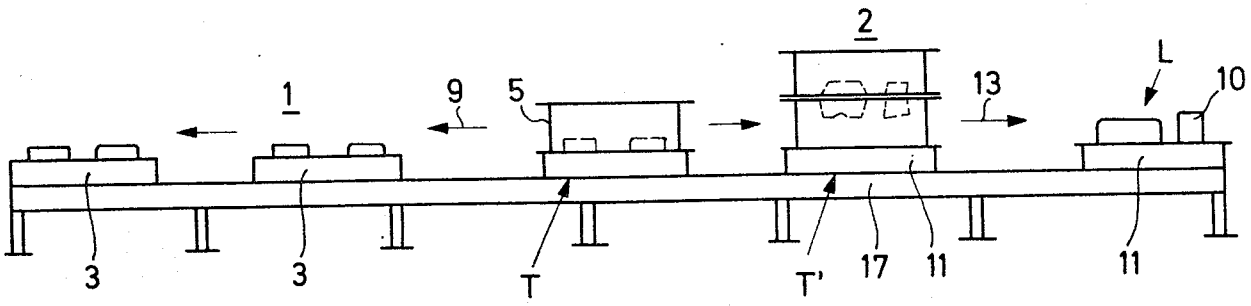
FIG. 2 is a highly schematic side view of the system of FIG. 1, taken in the direction of view from X.

The system illustrated in FIGS. 1 and 2 has two transport paths or loops 1, 2. Loop 1 is used for the production of molds made from pattern plates, for example for the repetitive production of similar patterns or, in any event, for the production of molds which are all contained on similar mold pattern carriers. The path or loop 2 is used for the production of molds from loose, individual patterns (without standardized pattern carriers). Both loops 1, 2 include transport apparatus, such as conveyors, and the like, as well known; roller-type conveyors are suitable to move the mold flasks, patterns, pattern carriers and the like from the station to station.

A pattern plate 3 (FIG. 1) and, schematically, including four sub-pattern plates all combined on the pattern plate carrier 3, is moved to a station F. A mold box, derived from a storage and supply station (not shown) is conducted in the direction of the arrow 6 to the station F. New pattern plates 3 are also introduced into the loop at this point. Pattern plates 3 and box 5 are joined together at station F. The pattern plates 3 and the box 5 are then moved by the conveyor in the direction of arrow 7 to a station M. Pattern plates no longer needed are removed at station M and those used are assembled under the box 5 at this station. Assembly may also be carried out at station F.

The assembled boxes or flasks are then transported to a station S, in which the boxes or flasks 5 are filled with sand, or other molding material. The filled boxes or flasks are then transferred to a holding or waiting station W, to be then introduced into a compaction press at a pressing station P. The sand filled into the flask or box at station S is compacted at the compaction station P. The compaction pressure is adjustable, as indicated by the dashed line to adjustment control P', shown schematically only. The finished, completed mold is then transferred to a station T in which the pattern plate and the mold form are separated. The mold is taken out of the production loop by a conveyor, in the direction of the arrow 8, and is now ready for pouring of the casting material. The pattern plate 3 is returned in the direction of the arrow 9 to the production loop for reuse and re-joining with another mold box at station F.

The second loop 2 does not use pattern plates; rather, loose patterns are used. Substrates, or plates 11 (FIG. 2) are fed to station L in the direction of the arrow 12, if supplied from a store or supply depot, or in the direction of arrow 13 if recycled from the production loop. The loose patterns 10 are placed on the substrate 11. A box 5, supplied for example from a storage area in the direction of the arrow 14, is also placed on the carrier. The box 5, substrate 11, and the pattern 10, therein, are then transported upwardly (FIG. 1) to a station G in which fine sand is filled into the box. The box is then transported to station V for pre-compaction and fixing, and locating the pattern within the box. The box 5, together with the substrate 11, is then transported in the direction of the arrow 15 to the sand filling station S, in which the remainder of the molding sand is introduced. The path of the substrate 11 is now identical to that of the first loop, namely from station S through the waiting station W and then to the compaction or press station P, and then to the separation station T. At that point the mold is sent to a station T', however, where the box or flask is separated from the substrate 11, and conducted to prepare the mold for pouring. The pattern 10 is removed at a station A. Portions of the form of the loose pattern are assembled subsequently to provide a form ready for pouring. The substrate 11, now released, is recycled to the station L in the direction of arrow 13. The drag portions of the box or flask may also be turned over at the position T', for transport in accordance with arrow 13 to station L with the patterns 10 still inserted therein, and for placement of the cope or top portion of the form at station L. Such now completely assembled forms are then continued, as before, in loop 2 to the station S and then through station W to compaction and pressure station P, the production sequence terminating in the station T' where the cope portion and the drag portion are separated, for transport to station A, and removal of the pattern 10, and re-assembly of the cope and drag portions and preparation of the mold for pouring.

A portion of the transport conveyor 17 is seen in FIG. 2; transport conveyor 17, preferably, is a roller conveyor (schematically shown by the two parallel confining lines thereof). The direction of transport at the left half from station T in FIG. 2 is to the left, that is, in accordance with arrow 9, on which the pattern plates 3 are moved. The substrates 11, however, are moved in the opposite direction, as indicated by arrow 13. The common portions of the two production loops 1, 2, that is, stations S, W, P and T, are indicated as common to the two loops in FIG. 1 by the use of both reference numerals 3 and 11 in the boxes schematically indicating the respective stations.

The arrangement of the production loops 1, 2, as schematically shown in FIGS. 1 and 2, provides a very flexible matching of available equipment to any particular production requirements. As desired, molds may be made with pattern plates, and from loose patterns. The compaction or press station with the compaction press therein operates at maximum capacity. Molds for casting of only a single, or small number of pieces can be efficiently made with the same equipment and at costs comparable to those of mass produced molds using pattern plates.

Figure 3:
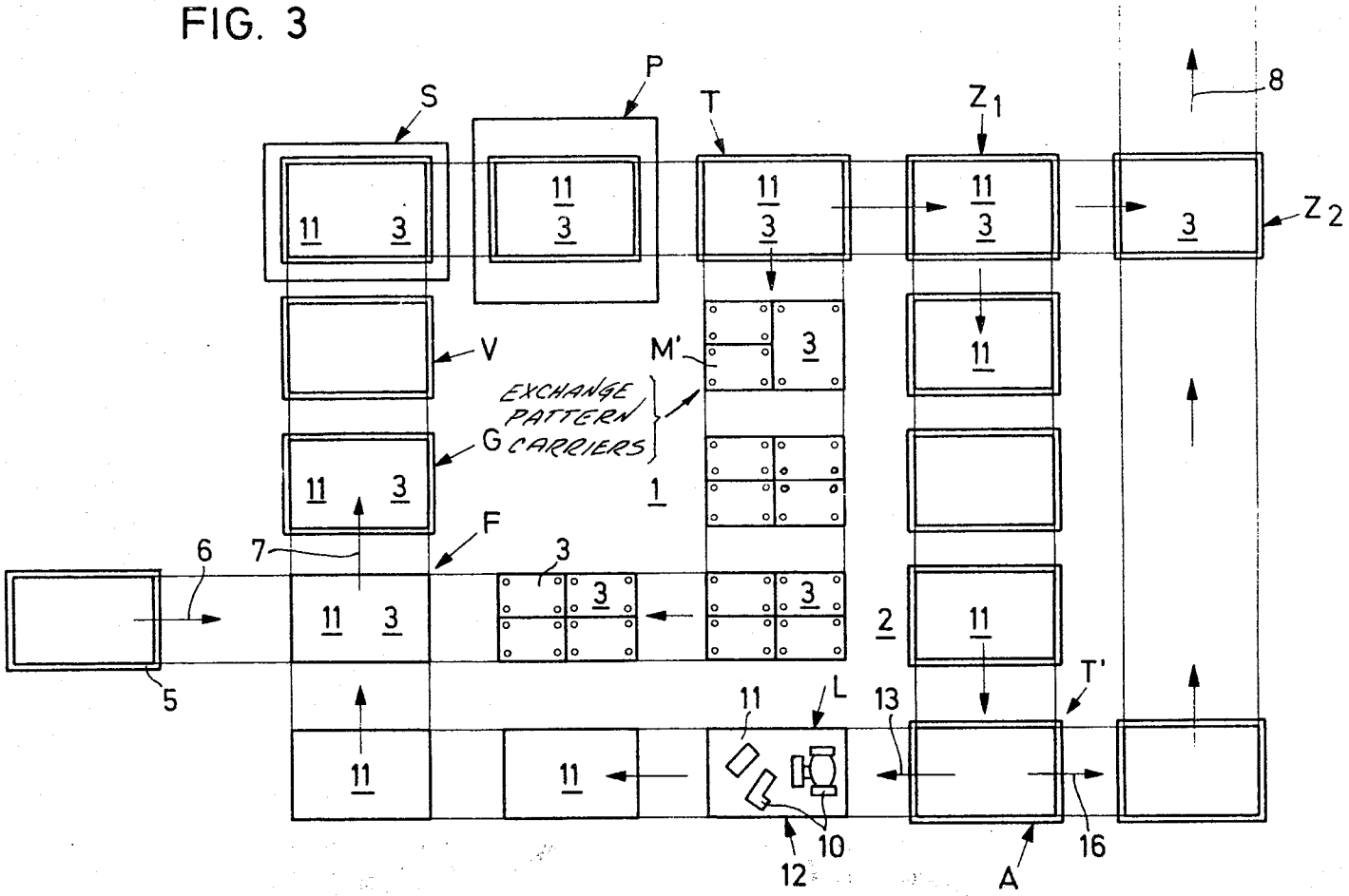
FIG. 3 is a schematic plan view of another embodiment of the system, in which the transport path or loop for pattern plates is located within the transport path or loop for loose pattern molds.

FIG. 3 illustrates an arrangement in which the two transport loops 1, 2 are so connected that the transport loop 1 for pattern plates 3 forms a portion of the transport loop 2 for loose patterns 10. This arrangement permits common use of additional equipment. In the system of FIG. 1, the equipment portions S, W, P and T are common to both loops; in the arrangement of FIG. 3, station F is additionally common to both loops. It is also possible to include stations G (filling of fine sand) and V (pre-compaction) in the common path F–T, although stations G and V are needed only for the production of molds for single patterns. Branch points Z1 and Z2, FIG. 3 permit branching of compacted molds; mold boxes with loose patterns 10 are branched at branch point Z1 to the station T', whilst the molds made by the pattern plates 3 are conducted to station Z2. Station Z2 actually is a junction from which, on the one hand, the finished forms or flasks made from pattern plates can be conveyed by conveyor 8 to a pouring or casting station, and receiving, additionally, the forms or flasks containing the pattern of the loose patterns 10, and derived from station A'. The transport path to the pouring or casting station thus also is common.

Station M of FIG. 1 is replaced by station M', in which pattern plates 3 are either recycled, or removed and exchanged for new pattern plates, which may carry a different pattern, as indicated schematically, by the difference of configuraion of the pattern plates 3 at station M', and therebelow.

The actual size of the production loop 1 in accordance with FIG. 3 is approximately the same as that of the production loop 1 in accordance with FIG. 2. For efficient operation, at least two complete sets of pattern plates are necessary.

Figure 4:
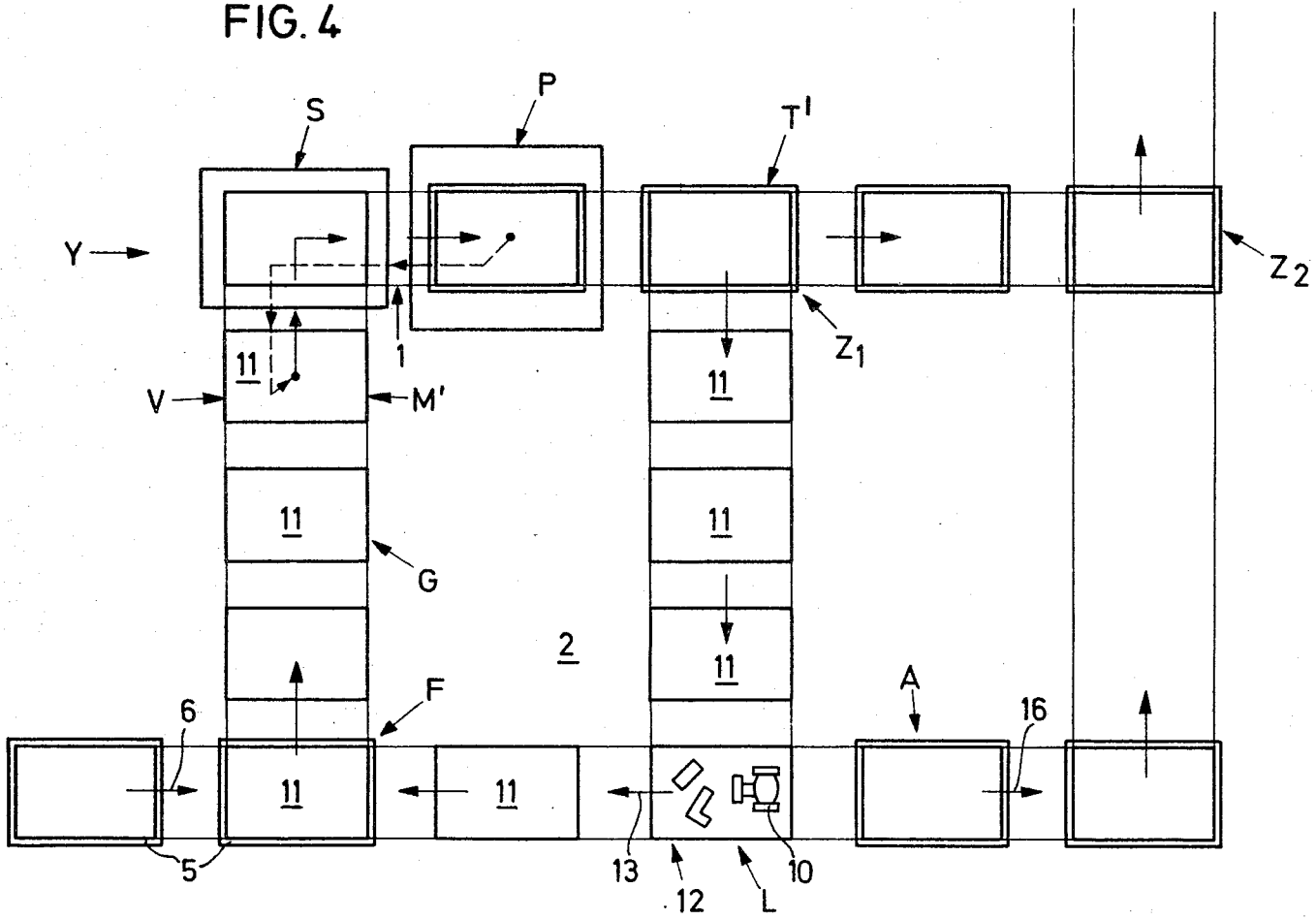
FIG. 4 is a top view of another embodiment of the system having a transport path or loop for molds using pattern plates and having only three stations, but located in two levels, above each other.
Figure 5:
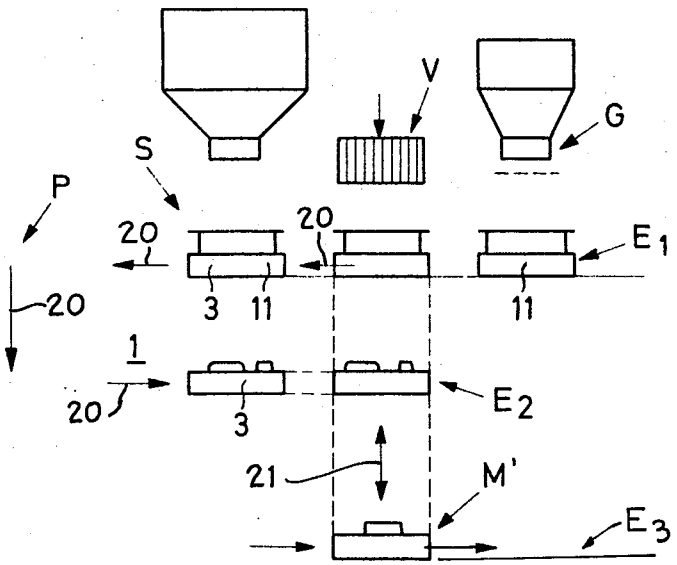
FIG. 5 is a schematic side view of the arrangement of FIG. 4, looked at in the direction indicated by the arrow Y of FIG. 4.

The embodiment of FIGS. 4 and 5 permits additional savings and a further spacial concentration of the production loops 1 and 2. The production loop 2, for the loose patterns 10, is similar to that of FIG. 3, and is not changed substantially. The production loop 1, as best seen in FIG. 5, is, however, geometrically much more compact and is carried over only three stations, M'

(exchange of pattern carriers), S (sand filling) and P, that is, the compaction or pressure station. Geometrically, the system is arranged in at least two and preferably three planes or levels E1, E2 and E3, as shown in FIG. 5 located above each other. The pressure station P is at level E1. The pattern plate 3, after separation from box 5, is returned at the lower level E2. An elevator-type conveyor (not shown) transfers the pattern carriers 3 upwardly to be assembled with a box or flask 5 at station V. Upon dropping of the pattern carriers 3 downwardly below the level of the plane E2 to level E3, the pattern carriers 3 may be exchanged for carriers of a different pattern arrangement or configuration at station M. Arrows 20 indicate the path of recycled plates; double arrow 21 the exchange path.

The actual construction of the various stations is well known, and need not be described in detail. The particular stations are linked in two transport paths or loops, one for pattern plates, and one for loose patterns. Incorporation of loose patterns in the overall arrangement permits flexible matching of available equipment to production requirements, as foundry orders are received and additionally increases the efficiency of preparation of mold forms using loose patterns. The expensive compaction press is used with high efficiency and at a high utilization rate not only for mass production, but also for the preparation of molds using loose patterns. The very same compaction press can be used for the preparation of the drag portion as well as of the cope portion of a pattern. The compaction pressure can be set by adjustment of the pressure (control) P', FIG. 1), the pressure being set in accordance with the contents of the patterns in the mold as signalled, for example, when the mold is at the waiting station W (FIG. 1), for example through a suitable signalling line as indicated, schematically, by the chain-dotted line, or by visual inspection. For example, the compaction pressure to prepare the second half, or portion of the mold box, may be less than that of the first half; or it may be similar.

The parts and components referred to in FIGS, 3–5 which have the same reference numerals as those in FIGS. 1 and 2 are similar thereto, and have not been described again.

Various changes and modifications may be made, and embodiments described in connection with any one of the FIGS. may be used in connection with any of the others, within the scope of the inventive concept.

I claim:

1. A system to make casting molds, selectively, from repetitively used patterns assembled on pattern plates (3), and from loose patterns (10), having operating stations (F, M, M', S, P, L, T, T') including a loading station (F. M. M') in which first mold boxes (5) are loaded with pattern plates (3);

means (T, 9) to return the pattern plates (3) after preparation of the mold, for re-use;

loading means (L) in which second mold boxes (5) are loaded with loose patterns (10);

a press station (P) to compress molding sand in the boxes, and a conveyor transport system (17) to circulate the pattern plates, the loose patterns and the mold boxes;

said conveyor transport system comprising a first conveyor portion solely handling pattern plates (3) and including said loading station (F, M, M') in which first mold boxes are loaded with pattern plates and said means (T, 9) to return the pattern plates, after preparation of the mold, for re-use;

a second conveyor portion solely handling loose patterns (10) and including said loading means (L) in which second mold boxes are loaded with loose patterns, and a third common conveyor portion forming, together with said first conveyor portion (1) a first closed loop and, together with said second conveyor portion (2) a second closed loop, said third common conveyor portion including said press station (P) which forms a single press station common to both of said loops, the conveyor transport system selectively feeding to said single press station (P), said first and second boxes loaded, selectively, with said pattern plates (3) and said single patterns (10), said conveyor transport system then feeding said boxes to the respective first and second conveyor portions of said first and second closed loops.

2. System according to claim 1, wherein the second closed loop of the second conveyor portion (2) includes the loading means for said second mold boxes and comprises means supplying a base or substrate (11) on which the loose patterns (10) are disposed, means supplying the second mold boxes (5) and a turning station (T') to invert the second mold boxes to prepare the turned mold boxes for association with a further mold box at said loading means (L).

3. System according to claim 1, further comprising means (P') coupled to the press (P) to selectively set the compaction pressure thereof as required by the respective mold box being transported to the compaction press.

4. System according to claim 2, further comprising means )P') coupled to the press (P) to selectively set the compaction pressure thereof depending on whether the bottom part, or the bottom and top parts of the mold are applied to said press for compaction.

5. System according to claim 1, wherein the third common conveyor portion includes a sand filling station (S), and a mold-separating station (T, T'), said sand filling (S) and separating (T,T') stations of said loops, being common to both said loops.

6. System according to claim 5, wherein the first conveyor portion (1) for the pattern plates (3) is located at least in part within the geometric arrangement of the second conveyor portion (2) for the loose patterns, and said third common conveyor portion of the loops further includes a common station (F) for placing of mold boxes on the carrier plates (3) or on the loose patterns (10), respectively.

7. System according to claim 1, wherein the third common conveyor portion of the loops includes a sand filling station (S);

and wherein the sand filling station (S) as well as the press station (P) of the common conveyor portion of both said loops is located at a higher level (E1) than the level (E2) of at least part of the first conveyor portion (1) of the first loop.

8. System according to claim 7, wherein the first loop (1) is located on three levels (E1, E2, E3), the third level (E3) being below the second level (E2) and having a pattern plate interchange station (M') located thereat, the first closed loop having means to lower pattern carriers (3) to said interchange station (M') at the third level (E3) to exchange pattern plates with plates of different patterns.

* * * * *